US005200904A

United States Patent [19]

Tottman

[11] Patent Number: 5,200,904

[45] Date of Patent: Apr. 6, 1993

[54] COMPUTER AIDED DESIGN SYSTEM

[76] Inventor: Marie Tottman, Burbeck Court, 62A Gallowgate Square, Largs, KA30 8HZ, United Kingdom

[21] Appl. No.: 465,133

[22] PCT Filed: Aug. 26, 1987

[86] PCT No.: PCT/GB87/00602

§ 371 Date: Feb. 20, 1990

§ 102(e) Date: Feb. 20, 1990

[87] PCT Pub. No.: WO89/02001

PCT Pub. Date: Mar. 9, 1989

[51] Int. Cl.[5] ..... G06F 15/46

[52] U.S. Cl. ..... 364/470; 139/78

[58] Field of Search ..... 364/470; 66/231, 232; 139/62, 78, 99, 103, 317, 318

[56] References Cited

U.S. PATENT DOCUMENTS

| | | | |
|---|---|---|---|
| 3,634,827 | 1/1972 | Lourie et al. | 364/470 |
| 4,406,312 | 9/1983 | Egbers et al. | 139/453 |
| 4,556,945 | 12/1985 | Fry | 364/470 |
| 4,619,294 | 10/1986 | Sainen et al. | 139/99 |
| 5,014,756 | 5/1991 | Vogel et al. | 139/97 |
| 5,016,183 | 5/1991 | Shyong | 364/470 |

*Primary Examiner*—Jerry Smith
*Assistant Examiner*—Paul Gordon
*Attorney, Agent, or Firm*—Arnold, White & Durkee

[57] ABSTRACT

A computer aided system suitable for use in the design of woven portions of fabric, which system has a computer programmed to display weaving patterns defined by different user-defined selections of each of a plurality of weaving pattern variables. Signals from the computer are received by a weaving apparatus which selects and controls the individual movement of weft yarns from a group of warp and weft yarns in the apparatus.

11 Claims, 6 Drawing Sheets

COMPUTER AIDED DESIGN SYSTEM

The present invention relates to a computer aided system for design woven material and weaving.

The invention has particular application in designing weaving patterns and producing woven fabric samples having such patterns.

The design of woven fabric patterns involves a high degree of risk to a designer and pattern innovator due to the high costs and cumbersome nature of existing processes. Initially, the designer must develop ideas on paper and produce loom instructions. A loom has then to be 'set-up', a time consuming and labour-intensive process, meaning that from this point the designer is committed to a particular design. The sample then woven is of a minimum length of thirty meters but, as samples are frequently rejected, samples and thus great expense are often wasted. Hence, there is a tendency to use only tried and tested design templates and to modify these only slightly and slowly to reduce the reject rate. A reluctance for significant change results also in stereotyped designs.

Industrial producers of textiles have tried to alleviate the problems and expense associated with this early stage in the evolution of fabrics by using 'freelance' designers or design houses. This only displaces part of the problem, spreading the risk and expense over more organisations and introducing a greater time lag such that the whole system becomes even less responsive to changes in style or fashion.

Considerable time and money could be saved if designs could be visualised without samples or if there was an alleviation of the time consuming threading of the heald shafts or their equivalents, the movement of which forms the shed and dictates the fabric structure e.g. twill or plain, and an increase in the number of yarn types, thicknesses, counts and colours supplied by the warp beam.

Computer aided design systems have been developed to improve the process but, unfortunately, these have not significantly reduced the reject rate since samples are still needed to show the three-dimensional qualities and feel of the fabric which even the best screen display simulation cannot express.

According to the present invention there is provided a computer aided system for design of woven material and weaving, the system comprising a computer, input means for the computer whereby user-defined weaving variables may be input, the computer being arrnged to control in correspondence with the input weaving variables at least one operating function of a weaving system.

Preferably, the weaving variables include yarn type, colour, count, t.p.i. (threads per inch) and fabric structure.

Preferably also, the operating functions of the weaving system include warp yarn supply means, warp yarn tensioning means, shedding means having spacing devices and warp yarn movement means, beating-up means and fabric take-off means.

The warp yarn tensioning means may be upstream or downstream of the shedding means and function as a mass tensioning means, or as a wave tensioning means associated with the shed, or individual bobbin tensioning means associated with the warp yarn supply means.

The warp yarn supply means is of modular form, and contains sets of several yarns that can be inserted and removed and are attached to units hingedly related in book-leaf form.

The shedding means may have the warp yarn generally lowered, the roof of the shed being formed by individual lifts to each thread; or the warp yarn is generally raised, the floor of the shed being formed by increased tension to individual threads, with the tensioning means upstream as part of the warp yarn supply means or downstream as part of the beating-up means.

The spacing means may be fixed or movable combs, conduits, channels or curtain-ring-like means of either closed loops or else open loops where the ends of the loop run parallel but do not touch; or the spacing means may be individual needles that also form part of the individual thread movement means.

The spacing means is adjustable to allow for different numbers of threads per inch (t.p.i.); there may be employed a drum of lobed section with each lobe permitting modulation of the t.p.i. values, or various combs of different teeth widths, or a single comb which may be angled more acutely relative to the weft yarn insertion path to produce higher t.p.i. values.

Individual warp yarn movement means may be activated by pneumatic, electrical, electromagnetic or mechanical means or a combination of these means.

The weft insertion means may be effected by air-jet or water-jet means, rapier means, electromagnetic levitational means or gravitational means.

The beating-up means may work in a conventional manner for one-stage shedding or in a sectional manner for wave shedding, and comprise reeds, cams, combs or be capable of working in a scissor-like fashion.

Also the present invention provides a computer aided design system suitable for use in designing fabric weaving patterns, which system has a computer programmed to display weaving patterns defined by different user-defined selections of each of a plurality of weaving pattern variables, characterized in that said computer is connected to a weaving apparatus comprising a warp yarn supply means, shedding means, weft yarn picking means, beating-up means and fabric take-off means, said computer being connected to said apparatus so as to control said preselectable shedding control means and said individual warp yarn lifting means in accordance with said user-defined weaving pattern variables selections thereby to produce, in use of the system with a warp yarn arrangement in said warp yarn supply means corresponding to the user-defined selections of warp yarn arrangement variables of said weaving pattern variables, a woven fabric sample corresponding to the weaving pattern defined by the user-defined selection of weaving pattern variables.

In a further aspect the present invention provides a fabric weaving apparatus comprising a warp yarn supply means, shedding means, weft yarn picking means, beating-up means, and fabric take-up means, characterized in that said warp yarn supply means comprises a creel formed and arranged for detachably mounting a large plurality of warp yarn bobbins in a predetermined disposition; warp yarn tensioning means for holding the warp yarns; and warp yarn spacing means having individual warp yarn receiving guide means as defined herein provided with closing means formed and arranged for permitting laterally translational threading of said guide means whilst retaining said warp yarns in said guide means; and wherein said shedding means has individual warp yarn lifting means and preselectable shedding control means formed and arranged for defining a plurality of warp yarn lifting combinations.

Preferably the computer aided design system of the invention includes a weaving apparatus of the present invention.

In another aspect the present invention provides a warp yarn supply means comprising a creel formed and arranged for detachably mounting a large plurality of warp yarn bobbins in a predetermined disposition; warp yarn tensioning means for holding the warp yarns; and warp yarn spacing means having individual warp yarn receiving guide means as defined herein provided with closing means formed and arranged for permitting laterally translational threading of said guide means whilst retaining said warp yarns in said guide means.

Computer, computer programmes, mice, pens and the suchlike are already known in the art for providing on-screen displays of new patterns corresponding to pattern variables such as yarn type, colour, count and fabric structure, and therefore will not be considered in further detail. However, further computer programmes are included in the present invention, to control the weaving system in accordance with the user-selected weaving pattern variables.

Different forms of apparatus known in the weaving art may be used in the various sections of system of the invention.

Embodiments of the present invention will now be described, by way of example, with reference to the accompanying drawings, in which.

Figure 1:
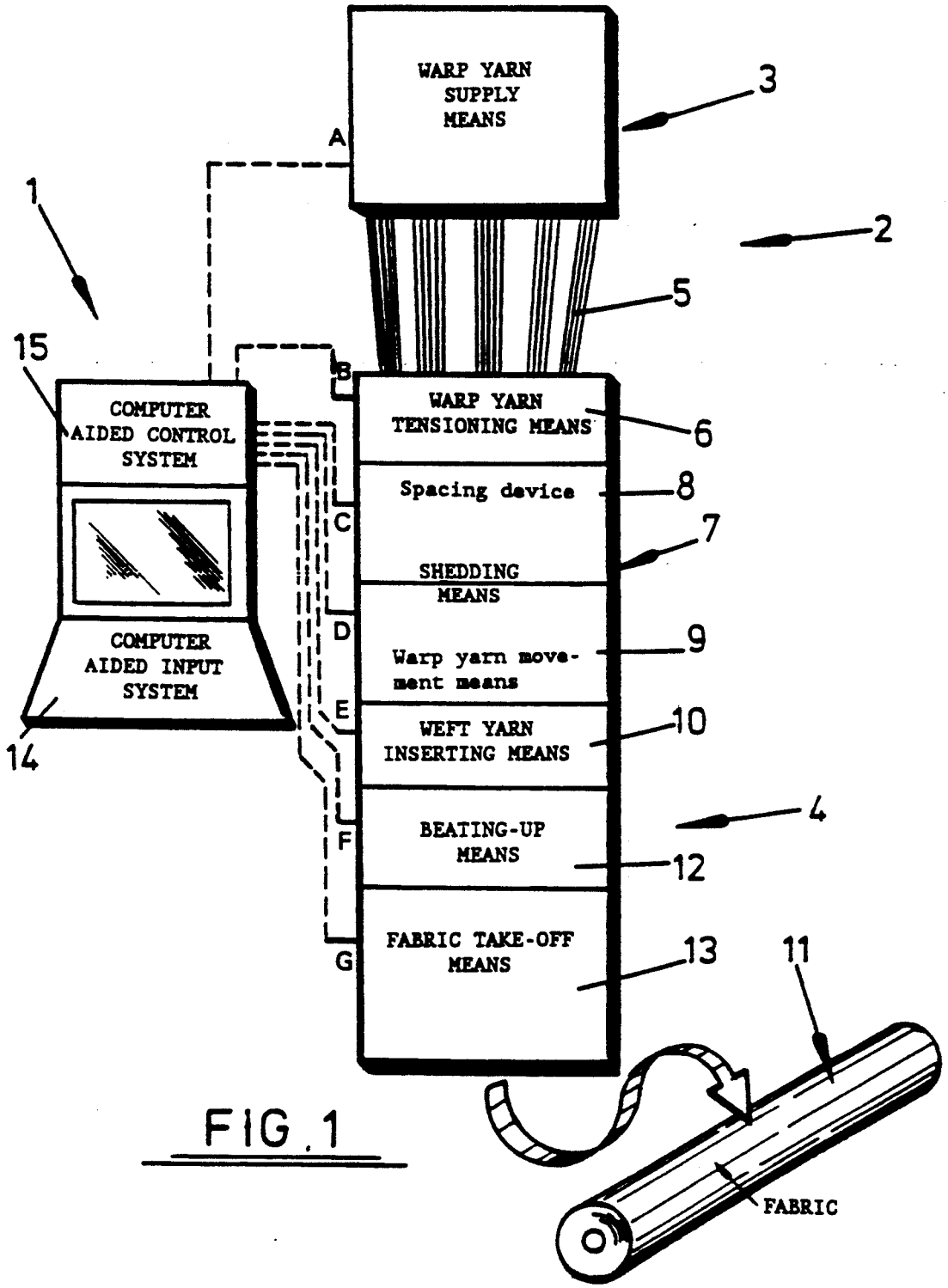
FIG. 1 is a block diagram of a computer aided system for design of woven material and weaving according to the invention.
Figure 2:
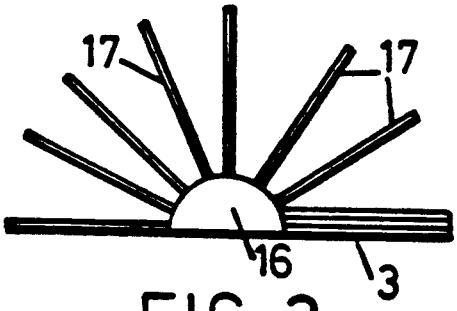
FIG. 2 is an end view of one form of warp yarn supply means for use in the computer aided system of FIG. 1 in the open position.

Referring to the drawings, FIG. 1 shows, in schematic form, a computer aided weaving system of the invention comprising a computer terminal 1 and a weaving system 2. The weaving system 2 has warp yarn supply means 3 providing a weaving loom 4 with warp yarns 5 which are gathered together by warp yarn tensioning means 6. The warp yarns 5 are then fed through shedding means 7 comprising spacing devices 8 which also help guide the yarns 5 and warp yarn movement means 9 which provides a path for weft yarn insertion means 10. The resulting fabric 11 is finished by beating-up means 12 and removed from the loom 4 by take-off means 13.

The computer terminal 1 having a computer aided input system 14 linked to a computer aided control system 15 modulates the weaving system 2 at one or more of a number of points A–G, though in this embodiment only the individual thread movement means 9 is controlled in this manner.

Figure 3:
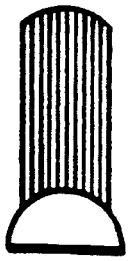
FIG. 3 is an end view of the warp yarn supply means of FIG. 2 in the closed position.
Figure 4:
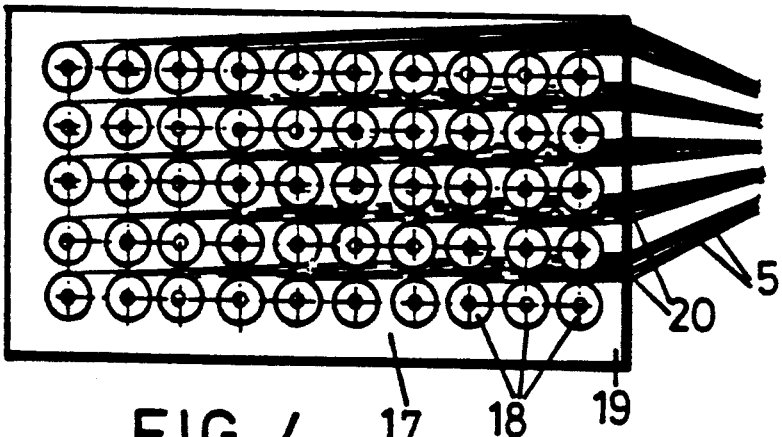
FIG. 4 is a side view, to a larger scale, of a bobbin support unit of the warp yarn supply means of FIGS. 2 and 3.
Figure 5:
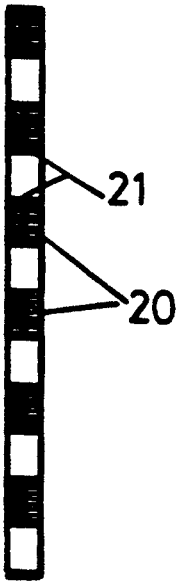
FIG. 5 is an end view, to a still larger scale, of the bobbin support unit of FIGS. 4.

Referring now to FIGS. 2 to 5 of the drawings, one form of warp yarn supply means 3 for use with the system of FIG. 1, has a main support 16 on which are hingedly mounted in bookleaf form a plurality of individual bobbin support units 17 which, in turn, carry a number of yarn bobbins 18. When the warp yarn supply means 3 is open (FIG. 2), complete units 17, parts of units or possibly individual bobbins 18 may be inserted or removed. In use, the warp yarn supply means 3 is generally in a closed-up form (FIG. 3). An end 19 of each unit 17 is provided with several sets of individual yarn guide and tensioning means 20 in the form of spring steel rings 21, well known in the art.

Figure 7:
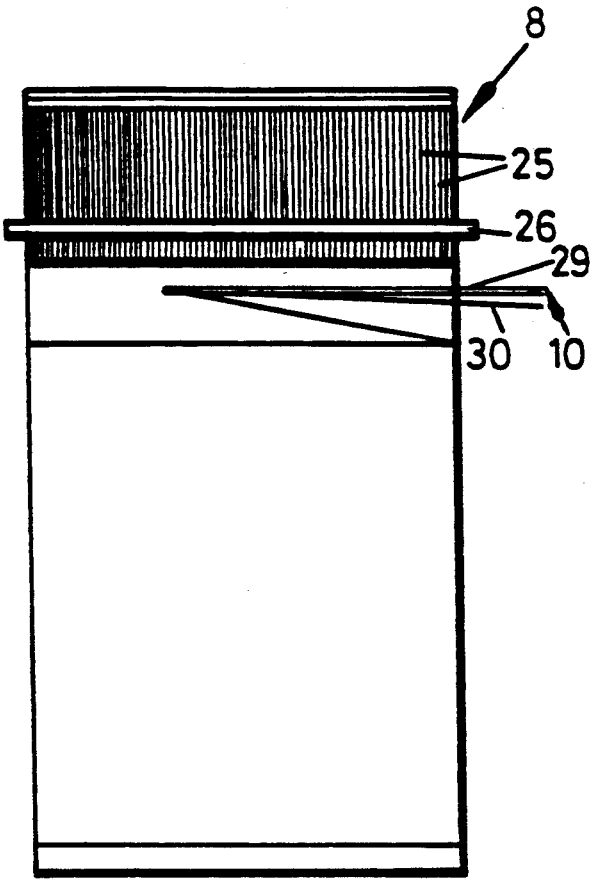
FIG. 7 is a top view of the weaving loom of FIG. 6.
Figure 6:
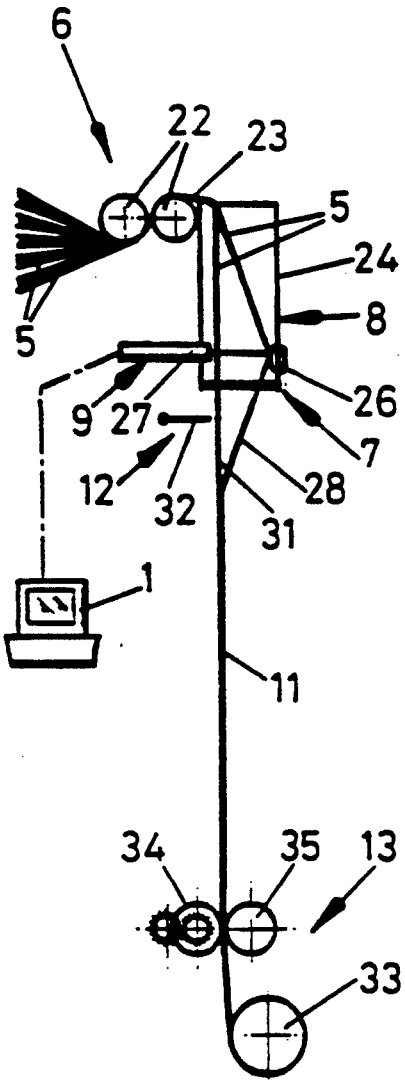
FIG. 6 is a generally schematic side view of one form of weaving loom of the invention.

Referring now to FIGS. 6 and 7 of the drawings, there is shown one form of a weaving loom 2 according to the invention, for weaving a fabric sample 11. The loom 2 is provided with mass warp yarn tensioning means 6 in the form of rollers 22 which gather yarns 5, received from the warp yarn supply means 3, into a uniformly tensioned warp yarn sheet 23 which is fed through a spacing device 8 in the form of a deep comb 24 which provides a large number of warp yarn guide means of parallel elongate channels 25.

Warp yarn movement means 9 comprising a plurality of airjets 27, one associated with each warp yarn 5, is disposed downstream of the channels 25.

An air jet serves to urge its associated thread against a bar 26 arranged transversely of the guide channels 25 such as to form a shed roof 28. The thread movement means 9 is controlled by the computer 1 to achieve the desired fabric structure. This control is effected by activating selected ones of the plurality of air-jets 27 which make up the thread movement means 9.

Weft yarn insertion means 10 in the form of a rapier 29 is disposed downstream of the thread movement means 9 for insertion of the weft yarn 30 between the shed roof 28 and shed floor 31 which is formed by threadsthat have not been moved. Beating-up means 12 in the form of a read 32 beats-up the inserted weft yarn 30 to form the fabric 11. This fabric 11 is then fed to a cloth take-up beam 33 through a driven fabric roller 34 and non-driven fabric roller 35.

Figure 8:
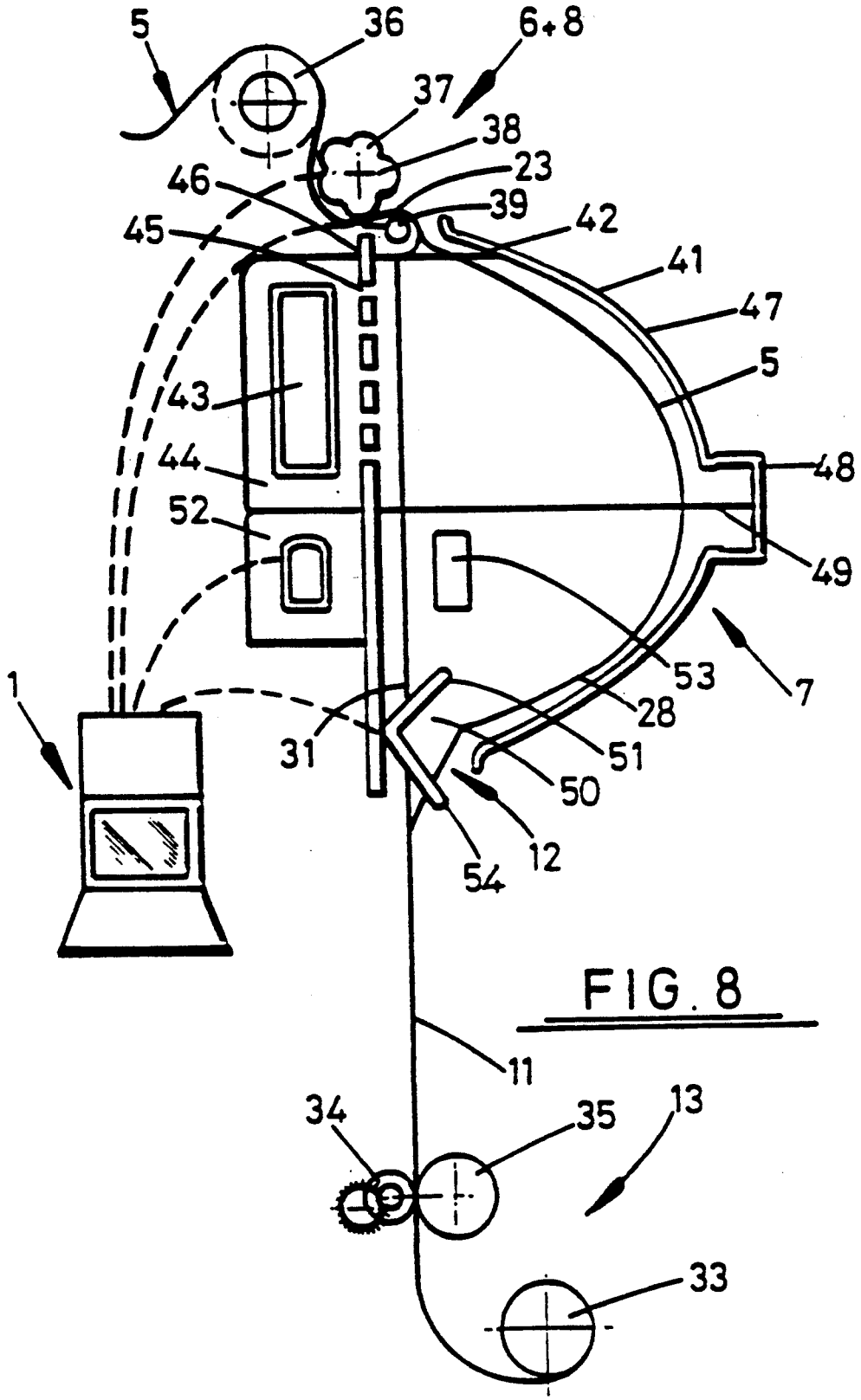
FIG. 8 is a generally schematic side view of a second form of a weaving loom of the invention.
Figure 9:
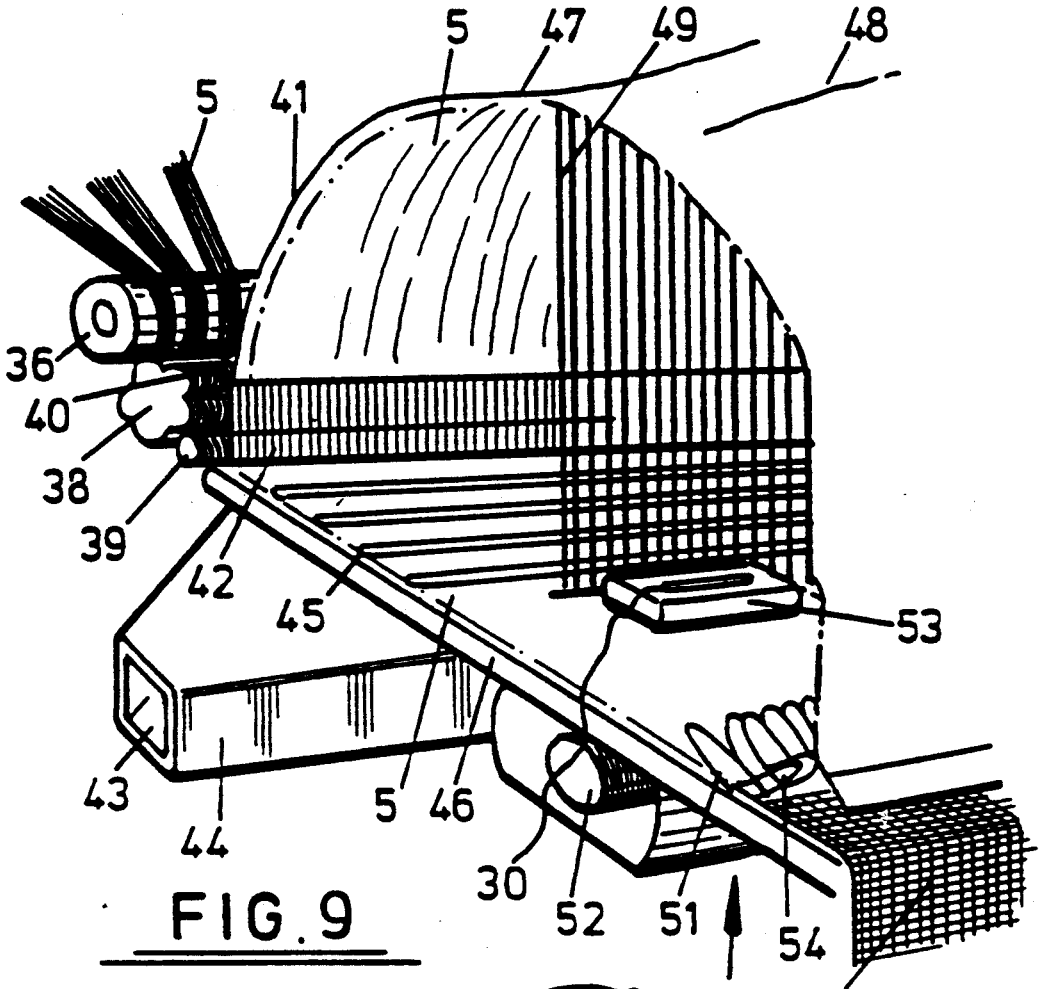
FIG. 9 is a perspective view of the weaving loom of FIG. 8.
Figure 10:
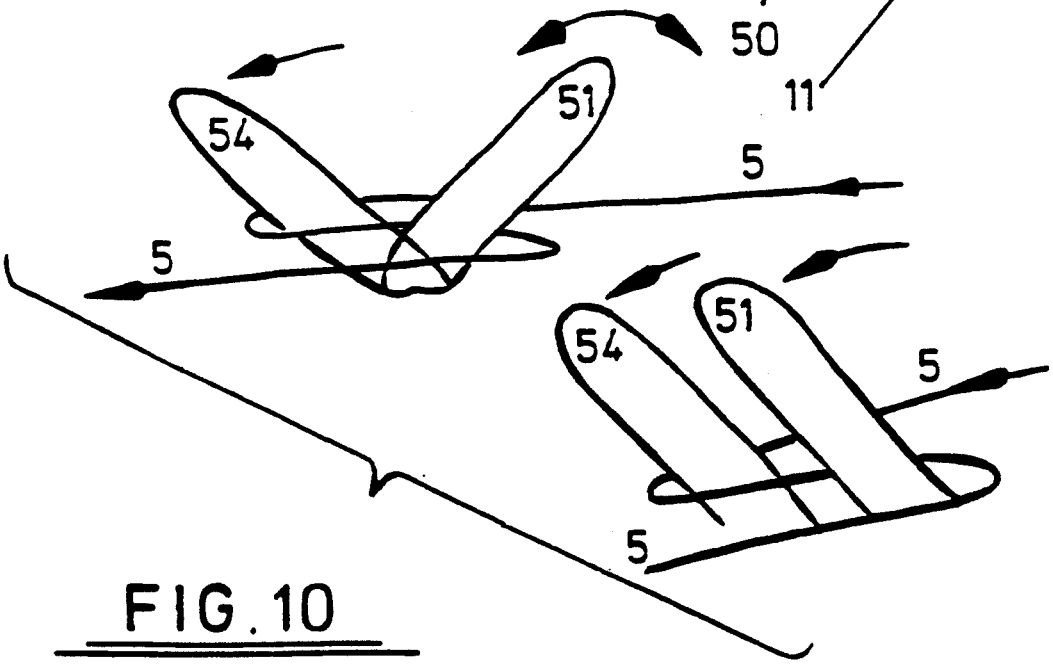
FIG. 10 is a side view of a detail of the weaving loom of FIGS. 8 and 9.

Referring to FIGS. 8 to 10 of the drawings, there is shown another embodiment of a weaving loom 2 according to the invention, for weaving a fabric sample 11. In this embodiment, the warp yarns 5 are fed over rollers 36, 38, 39 that keep the warp yarn sheet 23 uniform but the threads 5 not generally taut. Roller 38 is of lobed cross-section, having a plurality of axially spaced circumferential channels 40 on its surface. The axial spacing of the channels 40 on each lobe 37 of the roller 38 varies around the circumference of the roller 38 to permit modulation of the t.p.i. value.

The warp yarn sheet 23 is fed into a cage 41 of semicircular section, the threads being guided and kept separate by a shallow comb 42 at its entrance. Air, which is fed by a motor (not shown) through a rectangular aperture 43 to a basal chamber 44, is blown through slots 45 in the floor 46 of the cage 41, pushing the warp yarns 5 against the curved roof 47 of the cage 41, and is evacuated through a wedgeshaped outlet 48. The yarns 5 are prevented from tangling by a comb 49 centred on the axis of the cage 41. Threads 5 forming the shed floor 31 are put under tension by computer controlled individual tensioning means in the form of adjustable rollers 39 upstream of the air slots 45. Alternatively, the tension can also be provided by a two bladed yarn handling system 50 positioned downstream of the air slots 45, the scissor-like movement of fore-blades 51 of the system 50 creating the tension.

Weft yarn insertion means 10, in the form of a linear induction motor 52, propels a shuttle 53 across the shed floor 31 and is disposed upstream of the two-bladed system 50 which, in addition to tensioning, beats-up the weft yarn 30 by both blades 51, 54 beating in a downstream direction.

Figure 11:
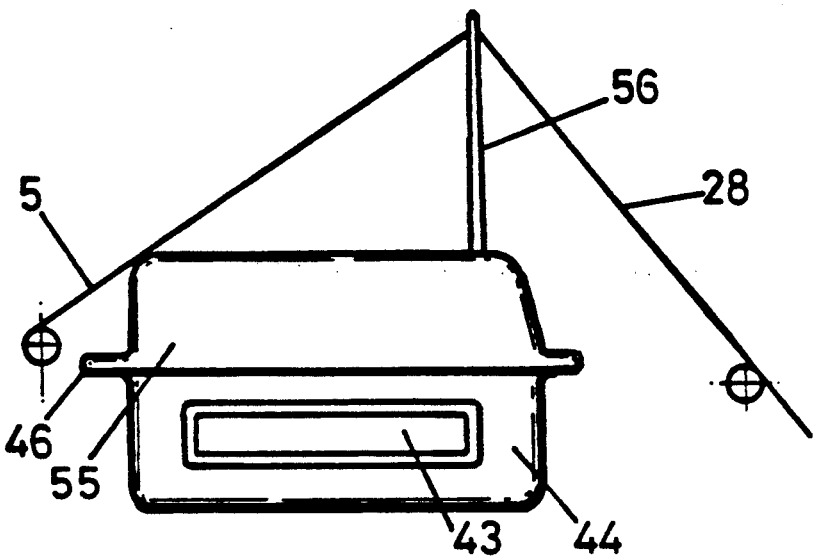
FIG. 11 is a side view of a raised thread lifting device of a third form of the weaving loom of the invention.
Figure 12:
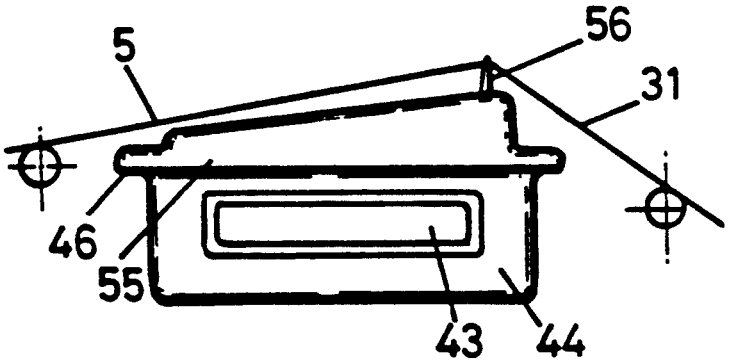
FIG. 12 is a side view of the thread lifting device of FIG. 11 in the lowered position.

FIGS. 11 and 12 show an alternative embodiment of shedding means 7. The air pulled in beneath the cage 41 raises an air cushion 55, situated upon which are upright needles 56, the warp yarns 5 to form the shed roof 28 passing through eyes (not shown) at the exposed tips of the needles 56 or, alternatively, resting across their V-shaped apices (not shown). The air is expelled via an otlet (not shown) in the floor of the chamber 44. The individual tension devices 39, 50 associated with the warp yarns 5 are reduced in importance since the individual needles 56 are brought down to form a shed floor 57 (FIG. 12) by a computer controlled carriage.

In other embodiments of the invention weft insertion is effected by water-jets, air-jets, or gravitational pull, the weaving loom having been rotated such that the weft insertion path is vertical, the shed depth not needing to be as deep nor the tension as exact since air pushed before the shuttle would separate stray threads. In addition, in other embodiments, individual thread movement means employ needles controlled by solenoids at their bases or motor controlled cams or rocking arms.

Further alternative embodiments have adjustable spacing means to allow for different t.p.i, values, the function of the lobed drum 38 being replaced by wafers of adjustable spacing, or one of a number of combs having alternative spacings, or a single comb which may be angled more acutely to the weft yarn insertion path to produce higher t.p.i. values. Still further embodiments have only, or in addition, a tensioning device associated with each individual bobbin on the warp yarn supply means.

In the computer aided system according to the invention, the computer controls at least one operating function of the weaving loom, preferably the shedding means. However, it may also control the warp yarn supply means, the warp yarn tensioning means, the spacing means in all its forms including combs or lobed rollers, the weft yarn inserting means, the beating-up means and the fabric take-off means, the computer controls these operating functions in response to and corresponding to user-defined selections of weaving variables as entered at the computer input means.

Modifications and improvements may be incorporated without departing from the scope of the invention.

I claim:

1. A computer aided design system suitable for use in designing and producing fabric weaving patterns in woven fabric portions, which system has a computer programmed to display weaving patterns and input weaving variables defined by different user-defined selections of each of a plurality of weaving pattern variables, wherein said computer is connected to a weaving apparatus comprising a warp yarn supply means, shedding means, weft yarn picking means, beating-up means and fabric take-off means, said computer being connected to said apparatus so as directly to control each individual yarn shedding control means of said shedding means and individual warp yarn lifting means in accordance with said user-defined weaving pattern variables selections thereby to produce, in use of the system with a warp yarn arrangement in said warp yarn supply means corresponding to the user-defined selections of warp yarn arrangement variables of said weaving pattern variables, a woven fabric sample corresponding to the weaving pattern defined by the user-defined selection of weaving pattern variables.

2. A system according to claim 1 wherein said shedding means comprises individual warp yarn displacement means comprising a large plurality of independently operable pneumatic jets and associated solenoids formed and arranged for interaction with respective individual warp yarns in use of the system.

3. A system according to claim 1 in which the shedding means has the warp yarn generally lowered, the roof of the shed being formed by individual lifts to selected yarn threads.

4. A system according to claim 1 wherein the warp yarn is generally raised, the floor of the shed being formed by increased tension to individual threads, with warp yarn tensioning means provided upstream as part of the warp yarn supply means or downstream as part of the beating-up means.

5. A system according to claim 1 which includes individual warp yarn spacing means having individual warp yarn receiving guide means as defined herein provided with closing means formed and arranged for permitting laterally translational threading of said guide means whilst retaining said warp yarns in said guide means.

6. A system according to claim 5 wherein the spacing means are in the form of fixed or movable combs, conduits, channels or split-ring-like means of either closed loops or else open loops where the ends of the loop run parallel but do not touch in overlapping relation, or individual needles that also form part of the individual thread movement means.

7. A system according to claim 5 wherein the spacing means is adjustable to allow for different numbers of threads per inch (t.p.i.).

8. A system according to claim 7 wherein the spacing means are in the form of a drum of lobed section with each lobe permitting modulation of the t.p.i. values, or various combs of different teeth widths, or a single comb which may be angled more acutely relative to the weft yarn insertion path to produce higher t.p.i. values.

9. A system according to claim 1 wherein the warp yarn supply means is of modular form, and contains detachably mounted sets of several yarns.

10. A system according to claim 9 wherein said sets of several yarns are attached to units hingedly related in book-leaf form.

11. A system according to claim 1 wherein is provided a weft insertion means wherein weft insertion is effected by air-jet or water-jet means, rapier means, electromagnetic levitational means or gravitational means.

* * * * *